US005231242A

United States Patent [19]

Chryssomallis et al.

[11] Patent Number: 5,231,242

[45] Date of Patent: Jul. 27, 1993

[54] PLASMA INJECTION AND DISTRIBUTION SYSTEMS

[75] Inventors: George S. Chryssomallis, Golden Valley; James P. Warren, Coon Rapids; Dennis Borgwarth, Anoka, all of Minn.

[73] Assignee: FMC Corporation, Chicago, Ill.

[21] Appl. No.: 794,110

[22] Filed: Nov. 18, 1991

[51] Int. Cl.[5] ..... F41B 6/00

[52] U.S. Cl. ..... 89/8; 124/3; 102/472

[58] Field of Search ..... 89/7, 8; 124/3; 313/143

[56] References Cited

U.S. PATENT DOCUMENTS

| | | | |
|---|---|---|---|
| 4,170,922 | 10/1979 | Peterson et al. | 89/7 |
| 4,352,397 | 10/1982 | Christopher | 149/44 |
| 4,711,154 | 12/1987 | Chryssomallis et al. | 89/8 |
| 4,895,062 | 1/1990 | Chryssomallis et al. | 89/8 |
| 5,072,647 | 12/1991 | Goldstein et al. | 89/8 |

FOREIGN PATENT DOCUMENTS

| | | | |
|---|---|---|---|
| 361811 | 10/1922 | Fed. Rep. of Germany | 313/143 |
| 216391 | 5/1924 | United Kingdom | 313/143 |
| 442421 | 2/1936 | United Kingdom | 313/143 |

*Primary Examiner*—Stephen C. Bentley

*Attorney, Agent, or Firm*—G. Wolde-Michael; R. C. Kamp; R. B. Megley

[57] ABSTRACT

The apparatus disclosed herein relates to plasma injection and distribution systems which release high energy plasma into a combustible mass to promote efficient combustion and maximize the muzzle velocity of a projectile. The devices inject plasma streams into a combustible mass in a coherent and directed manner such that pressure peaks and the resultant thermal and dynamic stresses are eliminated. Particularly, strategically positioned outlet orifices and nozzles enable the invasion of a propellant mass by plasma jet streams to create controllable uniform ignition and combustion therein.

23 Claims, 2 Drawing Sheets

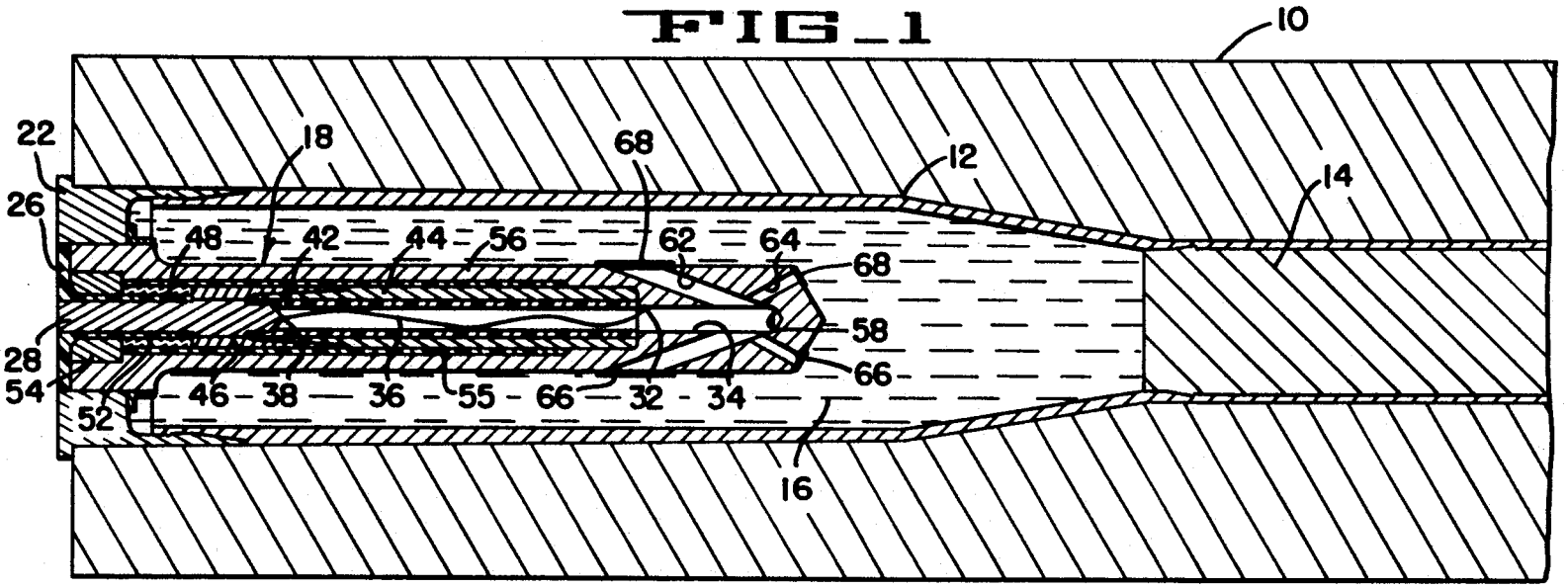
FIG_1
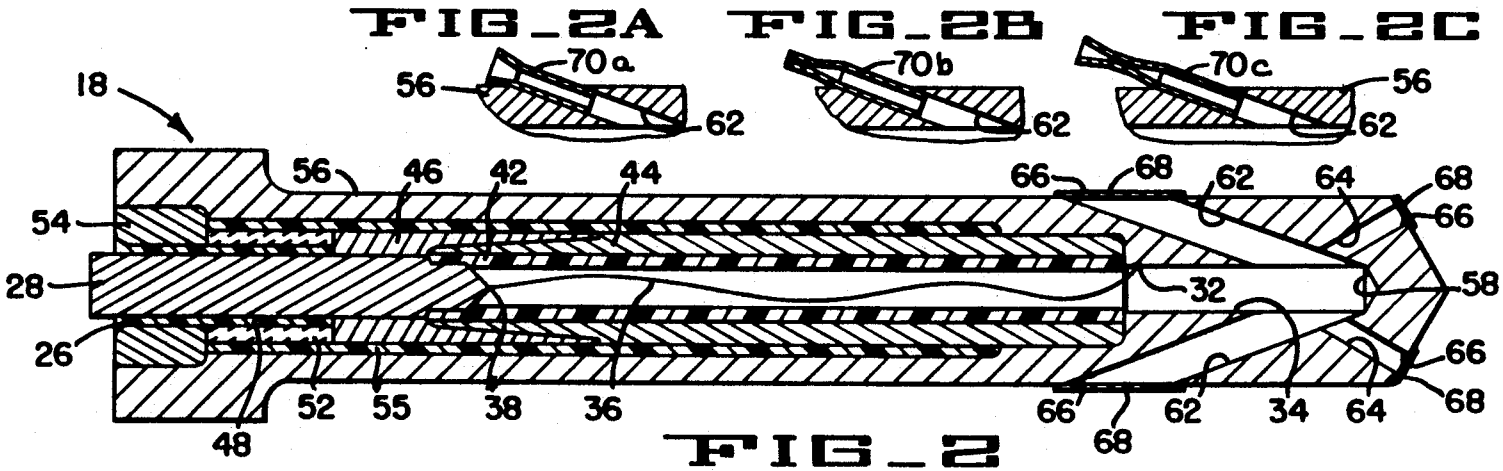
FIG_2A FIG_2B FIG_2C
FIG_2

PLASMA INJECTION AND DISTRIBUTION SYSTEMS

FIELD OF THE INVENTION

The present invention relates to plasma injection and distribution systems and more particularly to devices for injecting plasma into a propellant mass to induce efficient and controlled combustion.

SUMMARY OF THE INVENTION

It is an object of the present invention to provide devices for injecting and distributing plasma jet streams into a combustible media.

Another object of the present invention is to provide apparatus which enables invasion of a propellant mass with one or more plasma jet streams in order to control the rate and efficiency of combustion.

Yet another object of the invention is to inject and distribute plasma such that ignition and combustion of propellant contained within a cartridge of a gun is controlled to optimize projectile muzzle velocity.

To achieve the above objects, there is provided in accordance with the present invention a plasma injection and distribution system which includes a capillary having a bore with plasma distribution channels and outlet orifices branching out therefrom. Further, means for countering plasma flow and communicating with the capillary is provided. An anode and a cathode terminal are disposed at a first and a second end of the capillary, respectively. A fuse wire is provided to connect the anode and cathode terminals.

In another aspect of the invention, a cartridge integrated plasma injection and distribution system is disclosed in which a cartridge housing containing a combustible media wherein a capillary comprising a plasma injection and distribution system is disposed. The capillary has a bore with plasma distribution channels and outlet orifices branching out therefrom. Further, means for countering plasma flow in communication with the capillary is provided. An anode and a cathode terminal disposed at a first and a second end, respectively, are also located in the bore. A fuse wire connected to and extending from the anode terminal is connected to the cathode terminal. Further, an attachment is provided to secure the capillary inside the cartridge housing.

Furthermore, the present invention discloses a plasma injection and distribution system which includes means for countering plasma flow and a capillary having a bore therethrough and having a port means for plasma outlet in communication with the means for countering plasma flow. An anode and a cathode terminals disposed at a first and a second end of the capillary, respectively, with a fuse wire connected to and extending from the anode terminal and connected to the cathode terminal are also provided.

The present invention further discloses a cartridge integrated plasma injection and distribution system including a cartridge housing containing a combustible media situated behind a projectile and set in a gun barrel. A capillary comprising a plasma injection and distribution system is disposed adjacent to the cartridge and a coupling means is provided to integrally retain the cartridge and capillary in a breech block. The capillary with a bore therethrough also has a plasma outlet port including an anode and a cathode terminals disposed at a first and a second end of the capillary, respectively. A fuse wire disposed in the bore and extending therein provides a connection between the anode and cathode terminals.

BRIEF DESCRIPTION OF THE DRAWINGS

FIG. 1 is a central section of the plasma injection and distribution system of the present invention incorporated in a cartridge which is disposed in a gun tube.

FIG. 2 is an enlarged section of the embodiment of FIG. 1 depicting the plasma injection and distribution device of the present invention.

FIG. 2A is a section view depicting a divergent nozzle for plasma distribution.

FIG. 2B is a section view depicting a convergent nozzle for plasma distribution.

FIG. 2C is a section view depicting a divergent-convergent nozzle for plasma distribution.

DESCRIPTION OF THE PREFERRED EMBODIMENTS

Figure 3:
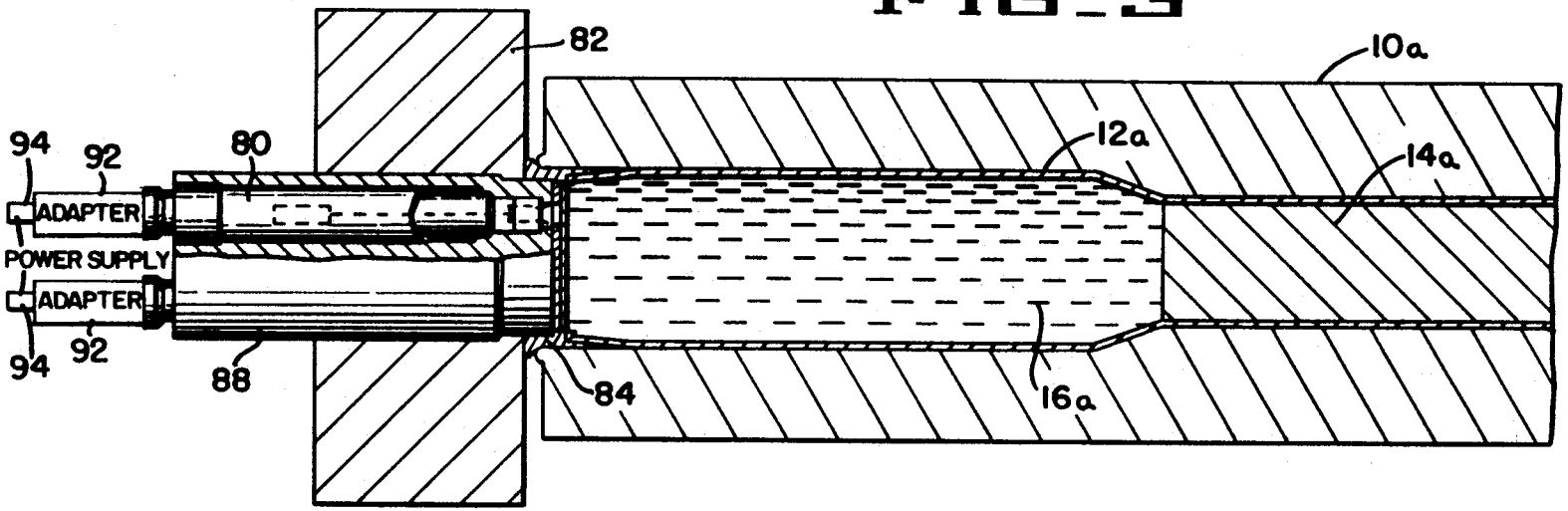
FIG. 3 is a section view of another embodiment of the present invention disposed in a breech block.

The plasma injection and distribution system disclosed herein is designed to provide a near uniform ignition and combustion of a propellant or a combustible mass. Uniform combustion limits pressure peaks and fluctuations which result from a propellant mass burning in a gun chamber. Particularly, uneven burning of a propellant mass results in the creation of pressure waves with very high pressure peaks which limit the type of propellant and the scheme of arrangement of the propellant that can be used in the gun. These pressure peaks create significant thermal and kinetic stresses on the combustion chamber, the gun tube and associated hardware and contribute to an inefficient energy yield for a given propellant mass and are therefore undesirable.

It is one of the objectives of the present invention to reduce and control uneven burning of a combustible mass where the source of ignition is a high energy plasma stream. Specifically, this disclosure relates to plasma injection and distribution systems which can be integrated with or coupled to a propellant containment cartridge. The embodiment of this invention is supplied with each new round of electrothermal ammunition cartridge. U.S. Pat. No. 4,895,062, Chryssomallis et al contains a disclosure of typical ammunition for use in a Combustion augmented Plasma (CAP) gun, wherein a high energy pulse forming network (PFN), plasma injector and capillary are set in the gun breech block and remain with the cannon as successive rounds are fired therefrom. The present invention is distinguished from earlier systems in as much as the plasma injection and distribution system is either integrated with or coupled to the ammunition round to be consumable and disposable while providing a controlled ignition and combustion of the propellant mass. Thus, the problem with regard to how to create a uniform ignition and combustion of a propellant mass while limiting pressure waves and peaks, in order to avert very high pressure waves and uncontrolled combustion, is one of the important subjects of this invention as will now be discussed herein below.

The embodiments of the plasma injection and distribution systems are shown in FIGS. 1, 2, 3 and 4. FIG. 1 shows a cartridge integrated plasma injection and distribution system. A gun barrel 10 is shown in which a cartridge 12 is set depicting a round ready to fire. The cartridge 12 is adjacent to a projectile 14 which is integrally attached to the cartridge 12. The cartridge 12 contains a combustible mass or propellant 16. A plasma injection and distribution device 18 is also disposed in the cartridge 12. A stub case 22 is used as a bottom cap for the cartridge 12 and also provides a structural connection between the cartridge 12 and the plasma injection and distribution device 18. An insulation means 26 forming a bottom support for and extending into the plasma injection and distribution device 18 provides an integral connection between the stub case 22 and the plasma injection and distribution device 18. Power is supplied to the plasma injection and distribution device 18 at the anode terminal 28.

Referring now to FIG. 2 an embodiment of the plasma injection and distribution device 18 is shown in detail. It includes the anode terminal 28 and a cathode terminal 32 disposed in a bore 34. A fuse wire 36 connected to and extending from the anode terminal 28 and connected to the cathode terminal 32 is also located in the bore 34. The anode terminal 28 protrudes into the bore 34 forming a pointed tip 38. An inner tube 42, made of a dielectric material, disposed along the outer circumference of the pointed tip 38 forms the inner wall with an axis along the length of the bore 34. A center tube 44 made of a dielectric substance is tapered to form a variable external diameter at one end and slidably fits over the inner tube 42 at the outer circumference of the pointed tip 38. A tubular insert 46, with tapered internal segment forming a variable diameter cavity to overlap and concentrically mate with the externally tapered segment of inner tube 44 at one end and to slidably fit over a portion of the extension of the anode terminal 28, is provided. The tubular insert 46 may be made of metallic substance such as aluminum or a dielectric substance such as plastic. Further, an electric insulation sleeve 48 is slidably set over the anode terminal 28. An insulative dielectric sleeve 52 is placed over a longitudinal segment of the insulation sleeve 48 to provide structural integrity. A spacer sleeve 54 is also placed over a longitudinal segment of the insulation means 26 to fill the cavity therein and provide structural support. A dielectric tube 55 is used to line a segment of the inner walls of the outer tube 56. The outer tube 56 forms the housing wherein all the aforementioned parts of the plasma injection and distribution device 18 are contained. The housing 56 can be made of metallic substance, wound high strength fiber, fiber glass, high strength plastic or material of equivalent structural quality and conductivity. The housing 56 provides an extension of the bore 34. The extension of the bore in the housing 56 is a cavity in communication with and forming a continuation of the bore 34 which terminates at a blocked end 58. A plurality of plasma distribution channels 62 and 64 are arranged in communication with the extension of the bore 34 to form outlet orifices 66 at their extremities. The plasma distribution channels 62 and 64 branch in a plurality of directions. The outlet orifices 66 are provided with membrane covers 68 to isolate the plasma distribution channels 62 and 64 from the surrounding combustible media 16 as shown in FIG. 2. As shown in FIGS. 2A, 2B and 2C, the outlet orifices 66 may be nozzles having streamlined cross-sections with a divergent outlet 70*a*, convergent outlet 70*b* and or convergent-divergent outlet 70*c*.

The disclosed invention relative to the embodiments shown in FIGS. 1 and 2 can be designed to accomodate plasma injection and distribution needs for a given gun system. The operational sequence for the device of FIGS. 1 and 2 begins with the supply of voltage at the anode terminal 28 via a pulse forming network (PFN). The current travels to the pointed anode tip 38 which extends into the bore 34 and at which point a fuse wire 36 is connected. The fuse wire 36 explodes under the high-current high-voltage input from the PFN thus forming a plasma arc spatially contained within the anode terminal 28 and the cathode terminal 32. The coherence and durability of the plasma arc is sustained by ablating material such as the inner tube 42 which is made of dielectric substance. U.S. Pat. No. 4,711,154, Chryssomallis et al, contains a disclosure of typical capillary plasma flow manipulation and control, in a CAP gun, by filling the capillary with a material such as a dielectric substance to increase the electrical resistance. The manipulation of the flow of plasma is intended to control the reaction rate and influence pressure and acceleration profiles in the CAP gun.

Turning now to FIG. 2, the plasma which is created in the capillary bore 34 travels down the bore until it engages the blocked end 58. At this point the plasma is reflected back in the opposite direction to encounter plasma distribution channels 62 and 64, which branch in a plurality of directions to provide plasma flow components in parallel as well as opposite orientation to the direction of the flow of plasma from the anode terminal 28 to the cathode terminal 32. Moreover, the plasma distribution channels 62 and 64 are streamlined to encourage the flow of plasma in both the forward and backward directions such that both the rear and front end sections of the combustible media 16 (See FIG. 1) are exposed to plasma jets. This technique of segmented invasion of the combustible media 16 by plasma jets enables near uniform ignition and combustion throughout the media resulting in an efficient burning and the suppression of undesirable pressure peaks.

Particularly, one of the significant aspects of the disclosed invention is the imposition of directional changes on plasma flow to channel plasma jet streams into several areas of the combustible media 16. More particularly, the size and orientation of the plasma distribution channels 62 and 64 is streamlined to inject plasma into various segments of the combustion media 16. For example the size of the distribution channel 62 is approximately twice as large as that of channel 64. This proportional sizing of the distribution channels 62 and 64 results in plasma flow being distributed nearly equally at the outlet orifices 66. As the plasma makes a 180 degrees turn at the blocked end 58 it flows through distribution channels 62, rearward. However, proximate and upstream to the point of plasma discharge into the distribution channels 62, the distribution channel 64 manifold is located to direct a portion of the plasma forward in the direction of its original flow. The forward orientation of the distribution channels 64 coupled with the length and the size of opening enables the injection of plasma jet streams further forward into the combustible media 16.

Referring to FIG. 1, the plasma injection and distribution device 18 is shown integrated with a cartridge 12. In this assembly, the plasma outlet orifices 66 are provided with membrane covers 68 to prevent the migration of the surrounding combustible media 16 into the distribution channels 62 and 64 and eventually into the bore 34. Accordingly, when the plasma flows through the outlet orifices 66 it ruptures the membrane covers 68 before invading the surrounding combustible media 16.

As discussed hereinbefore, the plasma outlet orifices 66 may be fitted with nozzles as best shown in FIGS. 2A, 2B and 2C. The nozzles may be divergent as in 70*a*, convergent as in 70*b* and or convergent-divergent as in 70*c*. The use of a particular nozzle or combination of nozzles is dependent on several factors some of the important ones being plasma flow, mass and chemical properties of the combustible media 16.

Figure 4:
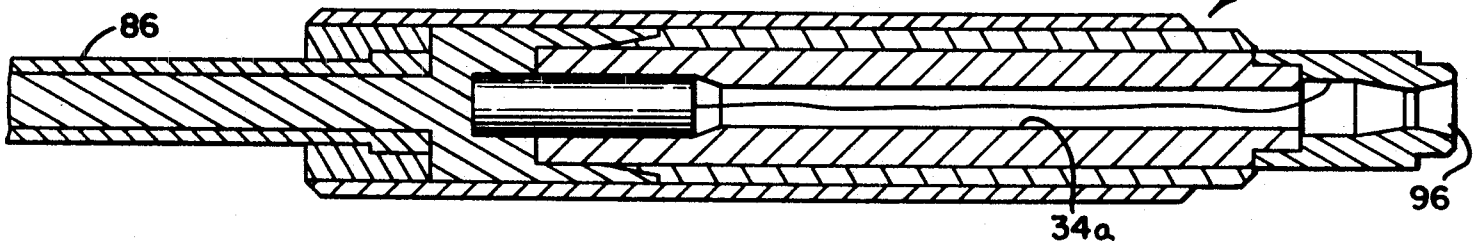
FIG. 4 is a detail section view of FIG. 3 depicting the plasma injection and distribution device of the present invention.

FIGS. 3 and 4 show another embodiment of the same invention wherein a gun barrel 10*a* is shown in which a cartridge 12*a* is set depicting a round ready to fire. The cartridge 12*a* is adjacent to a projectile 14*a* which is integrally attached to the cartridge 12*a*. The cartridge 12*a* contains a combustible mass or propellant 16*a*. A plasma injection and distribution device 80 is disposed in a breech block 82 and attached to the cartridge 12*a* by a retainer coupling 84.. A plurality of plasma injection and distribution devices 80 are disposed in a container means 88. Each plasma injection and distribution device 80 is supplied with an adapter 92 to accept an independent power supply 94.

The embodiments shown in FIGS. 3 and 4 are generally the same as those discussed hereinbefore and disclosed in FIGS. 1 and 2. The significant distinctions between them lies in the devices used to direct plasma into the combustible media 16*a*. Consequently, the common features such as the generation of plasma in a capillary and the associated hardware will not be discussed. Only the distinguishing elements and their functions will be discussed below.

Figure 4C:
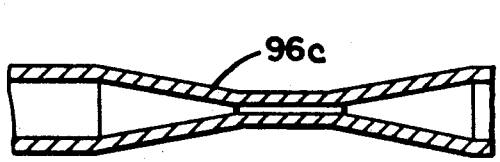
FIG. 4C is a section view depicting a divergent-convergent nozzle for plasma injection.
Figure 4B:
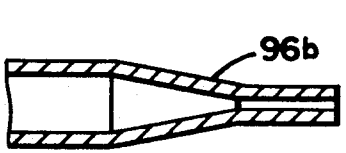
FIG. 4B is a section view depicting a convergent nozzle for plasma injection.
Figure 4A:
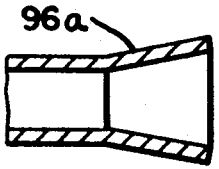
FIG. 4A is a section view depicting a divergent nozzle for plasma injection.

The plasma injection and distribution device 80 utilizes an orifice or nozzle 96 direct plasma into the combustible media 16*a*. The nozzle 96 is in direct communication with the bore 34*a*. The nozzle 96 has a streamlined cross-section to accelerate and direct plasma into the cartridge 12*a* and eventually into the combustible media 16*a*. The plasma outlet orifices may be fitted with nozzles as best shown in FIGS. 4A, 4B and 4C. The nozzles may be divergent as in 96*a*, convergent as in 96*b* and or divergent-convergent as in 96*c*. It should be noted that one or more nozzle types may be fitted to the outlet orifice of the plasma injection and distribution device 80. In order to maintain the integrity of the plasma jet stream and provide a reliable cross-section, the nozzle 96 is made of section comprising ablative and conductive materials to withstand the high pressure and temperature impact induced by the plasma jet streams. As shown in FIG. 3, a plurality of plasma injection and distribution devices 80 may be bundled together and attached to a cartridge 12*a* by a retainer coupling 84. Plasma jets from the plasma injection and distribution devices 80 are injected into the combustible media 16*a* contained in the cartridge 12*a*. Each of the nozzles 96 will inject plasma jets into the cartridge 12*a*. In essence, the number of plasma injection and distribution devices 80, stored in the container means 88, may vary depending upon the size of the cartridge and the plasma energy required to initiate ignition and provide uniform combustion of the propellant mass 16*a*.

Particularly, the embodiment in FIG. 3 and 4 provides a flexible plasma supply system as well as a system suited to accomodate limited failures. Since the supply of plasma is dependent upon the number of plasma injection and distribution devices 80 stored in the container 88, the plasma supply in this assembly is flexible and may be tailored to provide redundancy. Thus, unlike a single plasma generating unit, if one or more plasma injection and distribution devices 80 fail, the remaining others may be used to avert a total system failure and the round may be fired using the remaining plasma generation capacity.

Tests have shown that using either one of the plasma injection and distribution devices with an aggregate orifice opening of 0.75 inches and firing a 105 mm gun, a muzzle energy of 1.53 MJ with a muzzle velocity of 1181 m/sec was achieved.

The advances achieved by the disclosed invention therefore include the elimination of undesirable pressure peaks, the promotion of efficient combustion of the combustible mass or propellant and the elimination of runaway chemical reaction. Further, the disclosed invention enables the maximization of projectile energy content by providing a controllable combustion regime within the propellant mass. Additionally, as disclosed hereinbefore, by integrating the plasma injection and distribution with the ammunition cartridge and making it a consumable unit with the propellant, the operation of the CAP gun or any other electrothermal chemical gun is simplified and the system becomes conductive to achieving high firing rates.

Although the best mode contemplated for carrying out the disclosed invention has been herein shown and described, it will be apparent that modifications, variations, additions or omissions may be made without departing from what is considered to be the substance and subject matter of the invention.

What is claimed is:

1. A plasma injection and distribution system comprising:

a capillary having a bore with plasma distribution channels and outlet orifices branching out therefrom;

means for countering plasma flow in communication with said capillary;

an anode terminal disposed at a first of said capillary;

a cathode terminal disposed at a second end of said capillary; and a fuse wire means connected to and extending from said anode terminal and connected to said cathode terminal.

2. The plasma injection and distribution system of claim 1 wherein the capillary comprises an outer housing surrounding said bore.

3. The plasma injection and distribution system of claim 2 wherein the capillary comprises a plurality of dielectric substance layers forming said outer housing.

4. The plasma injection and distribution system of claim 1 wherein the plasma distribution channels comprise a plurality of divisions of a single channel into smaller branches.

5. The plasma injection and distribution system of claim 1 wherein plasma is formed between said anode terminal and said cathode terminal and said plasma distribution channels branch in a direction providing a flow component substantially parallel to a direction of plasma flow.

6. The plasma injection and distribution system of claim 1 wherein plasma is formed between said anode terminal and said cathode terminal and said plasma distribution channels branch in a direction providing a flow component substantially opposite to a direction of plasma flow.

7. The plasma injection and distribution system of claim 1 wherein said means for countering plasma flow includes a blockage at said second end to divert the flow of plasma into said distribution channels.

8. The plasma injection and distribution system of claim 1 wherein said outlet orifices comprise streamlined cross-sections to accelerate and direct plasma.

9. The plasma injection and distribution system of claim 1 wherein said outlet orifices comprise convergent nozzles to accelerate and direct plasma.

10. The plasma injection and distribution system of claim 1 wherein said outlet orifices comprise divergent nozzles to accelerate and direct plasma.

11. The plasma injection and distribution system of claim 1 wherein said outlet orifices comprise divergent-convergent nozzles to accelerate and direct plasma.

12. A cartridge integrated plasma injection and distribution system comprising:

a cartridge housing containing a combustible media;

a capillary comprising a plasma injection and distribution system disposed within said combustible media;

said capillary having a bore with a plurality of plasma distribution channels and outlet orifices branching out therefrom;

means for countering plasma flow in communication with said capillary;

an anode terminal disposed at a first end of said capillary;

a cathode terminal disposed at a second end of said capillary;

a fuse wire means connected and extending from said anode terminal and connected to said cathode terminal; and attachment means to secure said capillary inside said cartridge housing.

13. The cartridge integrated plasma injection and distribution system of claim 12 comprising a membrane cover means at said outlet orifices.

14. The cartridge integrated plasma injection and distribution system of claim 12 wherein said plurality of plasma distribution channels having outlet orifices direct plasma in a direction substantially toward said capillary first end and into said combustible media.

15. The cartridge integrated plasma injection and distribution system of claim 12 wherein said plurality of plasma distribution channels having outlet orifices direct plasma in a direction substantially toward said capillary second end and into said combustible media.

16. The cartridge integrated plasma injection and distribution system of claim 12 wherein said outlet orifices comprise outlet ports and nozzles streamlined to direct plasma into said combustible media.

17. The cartridge integrated plasma injection and distribution system of claim 12 wherein said plurality of plasma distribution channels and outlet orifices extend in a direction toward both said capillary first and second ends whereby a plasma jet is simultaneously directed toward opposing sections of said combustible media to thereby ignite and induce near uniform combustion.

18. The cartridge integrated plasma injection and distribution system of claim 12 comprising a stub case means integrally coupled to said cartridge housing, for securing said capillary therein.

19. A plasma injection and distribution system comprising:

means for countering plasma flow;

a capillary having a bore therethrough and having a port means for plasma outlet in communication with said means for countering plasma flow;

an anode terminal disposed at a first end of said capillary;

a cathode terminal disposed at a second end of said capillary; and a fuse wire means connected to and extending through said bore from said anode terminal and connected to said cathode terminal.

20. The plasma injection and distribution system of claim 19 wherein the capillary comprises an outer housing surrounding said bore.

21. The plasma injection and distribution system of claim 19 wherein the capillary comprises a plurality of dielectric substance layers.

22. The plasma injection and distribution system of claim 19 wherein said plasma outlet port comprises a plasma injection nozzle in communication with said capillary bore.

23. The plasma injection and distribution system of claim 22 wherein said nozzle comprises streamlined cross-sections to accelerate and direct plasma.

* * * * *